United States Patent [19]

Rigg et al.

[11] Patent Number: 4,980,691

[45] Date of Patent: Dec. 25, 1990

[54] DISTRIBUTED PLANAR ARRAY BEAM STEERING CONTROL WITH AIRCRAFT ROLL COMPENSATION

[75] Inventors: Steven H. Rigg, Norcross; Jeffrey A. Leddy, Alpharetta; Norman E. Johnson, Duluth, all of Ga.

[73] Assignee: Electromagnetic Sciences, Inc., Norcross, Ga.

[21] Appl. No.: 353,431

[22] Filed: May 18, 1989

[51] Int. Cl.[5] ..... H01Q 3/22; H01Q 3/24; H01Q 3/26

[52] U.S. Cl. ..... 342/372

[58] Field of Search ..... 342/372

[56] References Cited

U.S. PATENT DOCUMENTS

| | | | |
|---|---|---|---|
| 4,315,262 | 2/1982 | Acampora et al. . | |
| 4,445,098 | 4/1984 | Sharon et al. . | |
| 4,445,119 | 4/1984 | Works . | |
| 4,639,732 | 1/1987 | Acoraci et al. | 342/371 |
| 4,649,390 | 3/1987 | Andrews et al. | 342/140 |
| 4,724,438 | 2/1988 | Arnold et al. | 342/157 |
| 4,733,240 | 3/1988 | Bradley | 342/372 |

OTHER PUBLICATIONS

Waldron et al., "Distributed Beamsteering Control of Distributed Phased Array Radars", 29 *Microwave Journal*, No. 9, pp. 133–146 (Sep. 1986).

*Primary Examiner*—Theodore M. Blum

*Attorney, Agent, or Firm*—Nixon & Vanderhye

[57] ABSTRACT

A distributed parallel processing architecture for electronically steerable multi-element RF array antennas provides real time rapid array updates with decreased hardware cost and complexity. The array is subdivided into plural sub-arrays (each sub-array has more than one RF radiating element) and a phase shift interface electronics ("PIE") device is provided for each sub-array. Parameters specific to the RF elements within the sub-arrays are preloaded into the corresponding PIE. Pointing angle and rotational orientation parameters are broadcasted to the PIEs, which then calculate, in parallel and in a distributed processing manner, the phase shifts associated with the various elements in their corresponding sub-arrays. Linearization, phase compensation for various factors (e.g., operating frequency, measured characteristics of individual RF elements, feed line delay to individual elements, etc.), and the initial phase shift calculations themselves are thus performed on essentially an element-by-element basis without requiring individual calculation hardware for each element. Array spoiling in response to real time array rotational orientation is provided. Update rates of greater than 10 kHz are attainable.

32 Claims, 8 Drawing Sheets

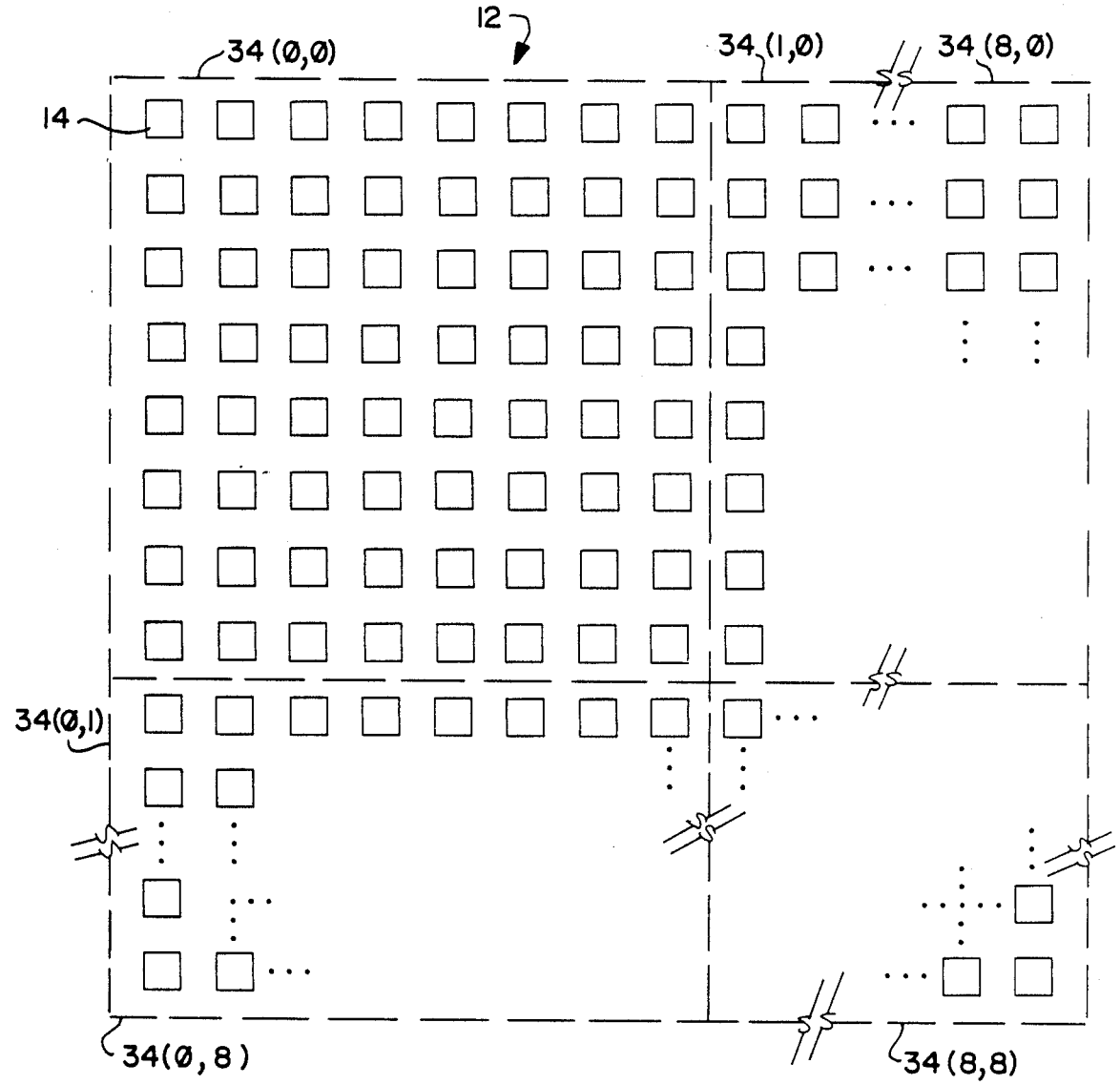
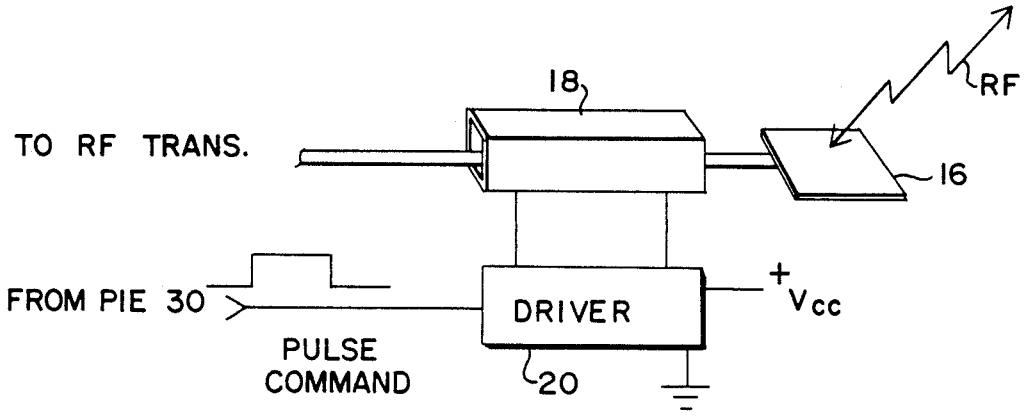
FIG. 1B PRIOR ART

PIE

PIE

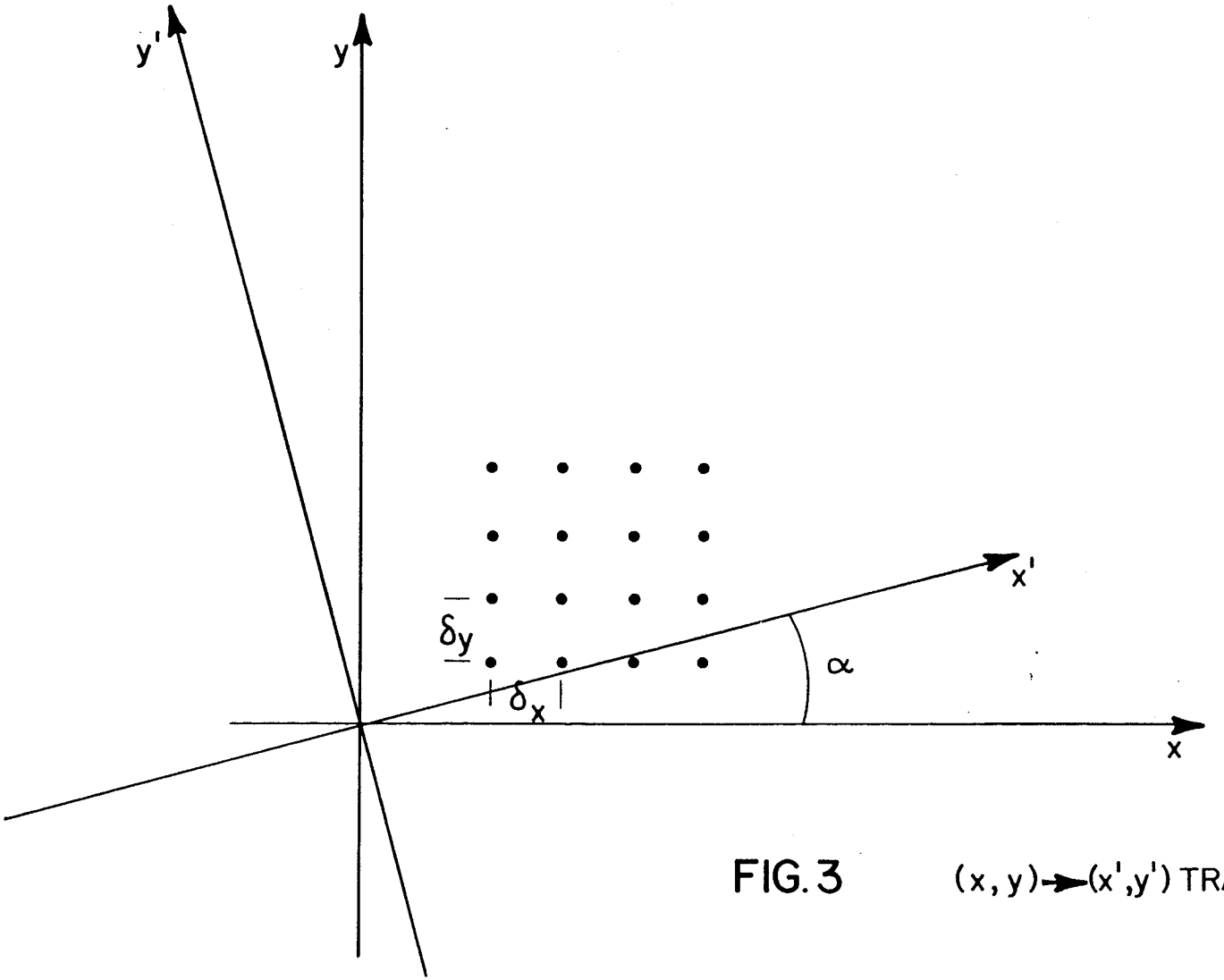
FIG. 3 (x, y) → (x', y') TRANSFORMATION

LINEARIZATION TECHNIQUE

DISTRIBUTED PLANAR ARRAY BEAM STEERING CONTROL WITH AIRCRAFT ROLL COMPENSATION

RELATED APPLICATIONS

This application is related to commonly-assigned copending application Ser. No. 07/333,961 of Wallis et al filed on 6 Apr. 1989 entitled "Simplified Driver For Flux Ferrite Phase Shifter". The entire disclosure of this Wallis et al application is hereby incorporated by reference herein.

This application is also related to the following copending commonly assigned patent applications:

Application Ser. No. 07/330,617 of Roberts et al filed on 30 Mar. 1989 entitled "Hybrid Mode RF Phase Shifter" (attorney docket no 68-28); and Application serial no. 07/330,638 of Roberts et al filed on 30 Mar. 1989 entitled "Reciprocal Hybrid Mode RF Circuit For Coupling RF Transceiver To An RF Radiator" (attorney docket no 68-28).

FIELD OF THE INVENTION

This invention relates to electronically steerable array RF antennas, and more particularly to efficiently and rapidly controlling the variable phase shifters associated with plural discrete antenna array elements. Still more particularly, the present invention relates to a distributed processing architecture and method for efficiently and rapidly performing phase shift calculations required for beam steering, beam spoiling, and the like and for controlling phase shifters associated with each radiator element of an array antenna in accordance with the results of such calculations.

BACKGROUND AND SUMMARY OF THE INVENTION

Steerable array RF antennas are now commonly used in aircraft radar systems (and in other applications as well) because they are rugged, compact, can be conformal if necessary, have low profiles, and exhibit electronically "steerable" directional radiation characteristics. Generally such antennas include many hundreds (or even thousands) of discrete miniature RF antenna elements and an electrically controllable phase shifter circuit (e.g., a ferrite phase shifter) associated with each RF element. It is possible to control the RF radiation characteristics (including directivity) of the array by properly controlling the amount of phase shift provided by the phase shifter circuits. See, for example, commonly assigned U.S. Pat. No. 4,445,098 to Sharon (1984).

Of course, for most or all desired radiation patterns it is not possible to use the same amount of phase shift for each element in the array. Rather, it is necessary to calculate (using for example multiple term trigonometric expressions) the phase shift for each individual array element and to then use the result of the calculation to control the phase shifts associated with the array elements (i.e., to provide a two-dimensional phase shift contour appropriate for the desired radiation characteristic).

Many factors go into the calculation of the new phase shift commands required to move the beam position in a steerable phased array (e.g., for example, planar types). Some of these factors include the azimuth and elevation (i.e. "beam pointing") angle, antenna feed compensation values, and linearization parameters (linearization is necessary because ferrite phase shift circuits are non-linear devices). Phase shift commands typically must also be varied with RF operating frequency and array temperature—adding further levels of computation. Moreover, reciprocal antennas (used for both transmit and receive) may require two phase shift calculations for each element: one for transmit and a different one for receive (since ferrite the phase shift circuits are generally not reciprocal).

Additional phase shift calculations are required if it is necessary to "spoil" the array during times of inactivity (e.g., to prevent the array antenna from being detected by enemy radar) or when a different antenna gain pattern is required. A beam spoiling function typically involves computing an additional phase offset (typically as a function of element position) for each element and applying the additional phase offset across the array. Beam spoiling may be symmetrical (where the same spoiling function is applied in the azimuth and elevation planes) or asymmetrical (where different spoiling functions are used in different planes). Difficult computational problems arise if an asymmetrical spoiling function is used with a non-stationary array (e.g., an airborne array subject to rotation during aircraft roll maneuvers), since the phase shift of each array element must be recalculated in real time in response to changes in array orientation.

Since phase shift calculations must typically be performed on an element-by-element basis, the number of required phase shift calculations is directly proportional to the number of elements in the array. Significant advantages are often obtained by using a relatively large array (e.g., a 64 element by 64 element rectangular array having 4096 discrete array elements). Unfortunately, even the fastest beam steering computers available under current technology are simply not fast enough to calculate on the order of 4096 different phase shifts and communicate the results of the calculations to control the 4096 individual phase shifters for a desired beam update rate of on the order of 10 kHz or higher.

Beam update rate is a particularly critical performance criterion. In a radar system, for example, it is typically necessary to perform a beam update within the two-way travel time to the minimum surveillance target distance (e.g., this two-way travel time is on the order of 100 microseconds for short to medium range airborne radar systems). That is, it is desirable for many reasons to be able to update beam parameters between the time an RF radar burst is transmitted and the time the burst returns to the array after being reflected by an object. It is also typically necessary to adjust the beam radiation characteristics in response to rapidly changing parameters (e.g., changes in desired beam directionality, array orientation due to aircraft roll, RF operating frequency, etc.) Unfortunately, even if the beam steering computer were capable of performing the necessary calculations at a sufficiently high rate, it would be difficult or impossible to reliably transfer the calculation results to the individual phase shifters in time to update the entire array.

Centralizing beam steering calculations in the beam steering computer makes very efficient use of the beam steering computer hardware (and also in the past has provided very rapid calculation speed because of the efficiencies resulting from performing all required calculations together). Unfortunately, this approach requires all data to be transmitted from the centralized computer to the individual phase shifter circuits (these circuits are typically located at or near their associated array RF element). While various techniques (e.g., multiplexing, direct memory access techniques, multiple port arrangements, outboard "smart" parallel communications coprocessors, and the like) are known for rapidly transferring data from a central computer to hundreds or thousands of receiving nodes, the wiring required to accomplish such high rate data transfer for large RF arrays would be extremely complex (increasing the cost and reducing the reliability of the entire system) and might not work very well (or at all) in the hostile, noisy environment created by the RF radiating from the array.

One possible solution to the problem of slow beam steering computer interfacing (i.e., communications to phase shifter circuits) is to perform various required calculations beforehand and load the resulting phase shift commands into memories associated with individual or groups of phase shifter circuits. The beam steering computer may then simply control selection of the appropriate data in the memory in real time in response to changing operating conditions instead of actually recalculating and retransmitting the commands for all phase shifts each time the beam is updated. One problem with this approach is that it is somewhat inflexible (since most or all required phase shifts must be calculated beforehand rather than "on the fly" in response to actual changing conditions). Another related problem with this approach is that it is extremely memory intensive to provide a sufficient number of precalculated phase shift commands to control a large array to the precision typically required. This problem is exacerbated in systems requiring that the array spoiling function be compensated for array rotation.

Suppose, for example, that array spoiling function compensation for on the order of one or two degrees of rotation is necessary. It may be acceptable to provide, for example, a different spoiling function phase offset for each of 256 different rotational positions (i.e., a different offset for each 1.4 degrees or so of rotation). If 64 stationary array elements require 8K of memory for storing a set of non-spoiled phase shift commands that are compensated for array rotation, for example, then on the order of 1.28 MBytes of memory may be required to store the phase shift commands for the same 64 elements when spoiling is compensated for array rotation. Such large amounts of high speed memory are simply not feasible within the size and cost constraints of a practical system.

It is generally known how to distribute the processing of phase shift calculations to overcome some of the problems discussed above. See, for example, the following references disclosing the use of distributed processing in an array antenna beam steering processor:

Waldron et al, "Distributed Beamsteering Control of Distributed Phased Array Radars", 29 *Microwave Journal* no. 9, pages 133–146 (September 1986); and U.S. Pat. No. 4,445,119 to Works (1984).

The Works patent describes a distributed beam steering computer including a microcomputer circuit at each array element. Each microcomputer circuit stores data constants relating to the position of its associated element in the array. The common elevation angle, azimuth angle and frequency parameters (which are required for the phase shift calculations of all array elements) are broadcasted to all microcomputer circuits over a serial data line. Each microcomputer circuit performs a shift-and-add type algorithm to calculate a phase shift command in response to the broadcasted information and the locally stored information particular to its associated array element, and generates a resulting phase shift command word used to directly control the array element phase shifter circuit.

The Waldron et al article discusses that distributed array control may help to overcome some of the problems caused by increased complexity of beam forming and steering (e.g., for very large arrays, non-planar or conformal arrays, and for active aperture arrays requiring gain as well as phase control). The article surveys various possible distributed control architecture alternatives, including element level distributed processing (such as is disclosed in the Works patent) and partially distributed beamsteering computation (in which phase shift adder/controllers at each array element merely add partially computed results provided by the beam steering computer and therefore do not perform the entire computation). The article states that the partially distributed array control approach has severe limitations of not allowing element level corrections without providing additional element level hardware and much additional complexity in control node and interconnect architecture. The article concludes that element level distributed control (in which each element has an associated controller performing the entire phase shift computation at the element level) is the best choice for arbitrary array geometries and/or for those applications involving significant calculation complexity.

Although others in the past have used distributed parallel beam steering control parallel processing, significant improvements are possible.

The present invention provides a method and apparatus for updating the phase commands of a large planar array in real time at rates greater than 10 kHz using a unique distributed control architecture. State of the art advancements in integrated circuits and gate arrays and a new algorithm and architecture provided by the present invention make it possible to command smaller groups of ferrite phase shifters—circumventing the data transfer "bottleneck" and complex wiring of central computing systems. A high degree of integration makes this new approach feasible in cost, size and weight.

In accordance with one aspect of the present invention, an antenna array is subdivided into plural sub-arrays and a phase shift command calculation device ("phase shift interface electronics"—PIE) is provided for each of the sub-arrays. In accordance with this aspect of the invention, each sub-array comprises more than one array element (and preferably comprises a relatively large number of elements such as 64)—with associated phase shifter circuits. Each PIE is loaded beforehand with values specific to the sub-array it is associated with (e.g., position of the sub-array within the array, linearization and phase compensation parameters due to feed line delay, etc.). A beam steering computer broadcasts common (i.e., array element position independent) information (e.g., delta azimuth angle, delta elevation angle and rotational parameters) to all PIEs. Each PIE receives the broadcasted data and performs various phase shift angle calculations required to compute a phase shift command for each of the elements it is associated with.

Some of the calculations performed by the PIEs are intermediate calculations valid for several elements in the associated sub-array (e.g., due to the close positional relationship of all elements in the sub-array). In addition, the same hardware can be used in an iterative manner to calculate, in sequence, the phase shift parameters for all elements in the sub-array (the hardware is fast enough and the number of elements in each sub-array is small enough to provide a desired beam update rate on the order of 10 kHz or higher). Great savings in hardware (compared with providing an individual microcomputer calculation device for each array element) are provided.

As each PIE calculates final phase shift values, it stores the values in a bank of counter/registers (e.g., after the values are linearized using PROM mapping techniques). All counter/registers of all PIEs may produce timing pulse type phase shift commands essentially simultaneously as soon as all of the sequential calculations are performed.

The present invention thus provides a significant degree of parallel, distributed processing while avoiding the disadvantages (e.g., in terms of complexity, degraded reliability, increased weight and additional costs) of providing an individual microcomputer for each array element. Moreover, the present invention advantageously uses the simplified phase shifter driver described in copending Patent Application Serial No. 07/333,961 of Wallis et al cited above since only a single command line needs to be connected between the sub-array PIE and an associated phase shifter (thus simplifying the interconnection between sub-array element phase shifters and the sub-array PIE).

The present invention provides many advantages including the following:

Memory savings;

Significant decrease in the time added to update the entire array due to the reduction in the amount of data that needs to be transferred;

System beam update rate in excess of 10 kHz;

Lower hardware costs and complexity and increased reliability;

Phase compensation for arbitrary array and sub-array configurations;

Compensation for behavior parameters of individual array elements (e.g., feed delay compensation, and measured element radiating characteristics);

Compensation for rapidly changing parameters such as frequency and array temperature on the sub-array level; and Capable of spoiling the array asymmetrically and compensating the spoiling function for change in array orientation (i.e., rotation) without degrading beam update rate.

BRIEF DESCRIPTION OF THE DRAWINGS

These and other features and advantages of the present invention will be more completely understood by referring to the following detailed description of presently preferred exemplary embodiments together with the appended sheets of drawings, of which:

FIG. 1A is a schematic diagram of an exemplary configuration for the array shown in FIG. 1;

FIG. 1B is a schematic diagram of an exemplary element structure for each element shown in FIG. 1;

FIG. 3 is a graphical illustration of a x,y to x',y' transformation utilized by the preferred embodiment shown in FIG. 1;

DETAILED DESCRIPTION OF A PRESENTLY PREFERRED EXEMPLARY EMBODIMENT

Figure 1:
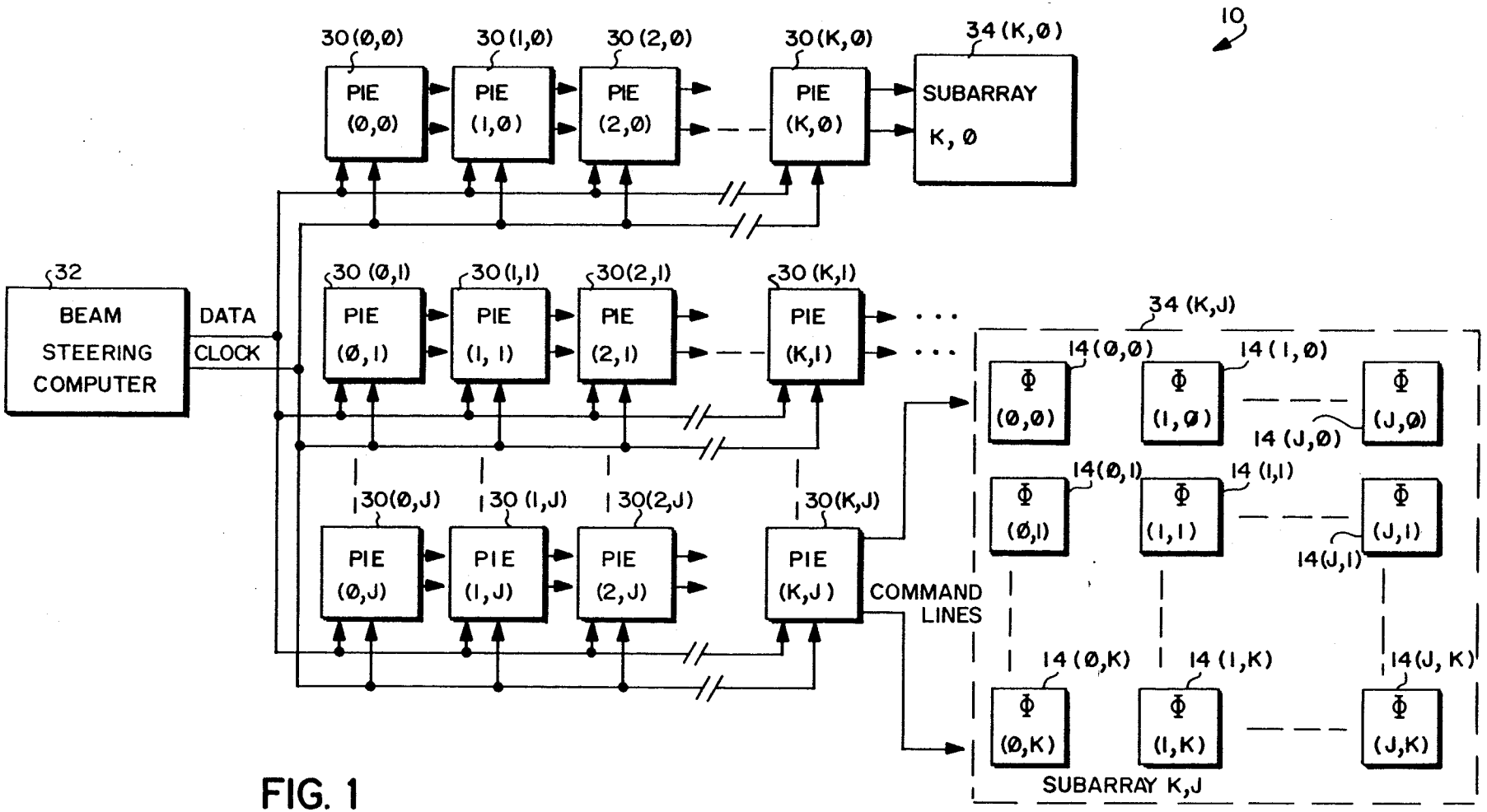
FIG. 1 is a high-level block diagram of the presently preferred exemplary embodiment of a beam steering control system in accordance with the present invention.

FIG. 1 is a high-level schematic block diagram of a presently preferred exemplary embodiment of a beam steering control system 10 in accordance with the present invention. Control system 10 in the preferred embodiment includes plural sub-array phase shift command calculation units (otherwise known as "phase shift interface electronics" or hereafter as PIEs) 30 each associated with a corresponding sub-array 34 of an overall planar RF array 12.

Referring for a moment to FIG. 1B, RF array 12 in the preferred embodiment is a rectangular planar array including multiple RF radiating blocks 14 arranged in a matrix of K rows and J columns. FIG. 1B shows an exemplary prior art configuration for each RF block 14 of array 12. In the preferred embodiment, each block 14 shown in FIG. 1A includes the following: (a) an RF radiating element 16 (e.g., a microstrip radiator); (b) a ferrite type phase shifter circuit 18 connected to the radiating element for controlling the phase shift of RF signals applied to and/or received from the RF radiating element; and (c) a driver circuit 20 of the type described in copending commonly assigned U.S. Patent Application Ser. No. 07/333,961 of Wallis et al filed 6 Apr. 1989 (attorney docket No. 68-15). In the preferred embodiment, the driver 20 is co-located with its associated RF radiating element 16 and phase shifter circuit 18. As is described in much greater detail in the Wallis et al application, each driver circuit 20 controls its associated phase shifter in response to phase shift commands applied to it in the form of pulses having widths specifying the desired phase shift. In the preferred embodiment, the PIE 30 associated with a particular RF block 14 generates timing pulses having widths corresponding to the desired phase shift to be used with that RF block 14. As is explained in the Wallis et al patent application, the use of pulse width parameters to provide phase shift commands greatly simplifies the wiring connections between phase shifter circuits 16 and associated PIEs 30—since only a single line needs to be connected between the PIE and any one RF block 14.

If a beam steering computer 32 were to control RF blocks 14 directly, some sort of circuitry would be required to convert phase shift commands generated by the beam steering computer into pulse width commands required by blocks 14. For example, a pulse width controller circuit associated with each driver 18 might be loaded either serially or in parallel with the appropriate value. An execute command might then be used to start each pulse width command simultaneously. However, this presents difficulties when large arrays are used. For example, in order to achieve a 10 kHz update rate for a large array (e.g., a 64×64 element phased array 12 containing 4096 array blocks 14), all elements in the array would need to be loaded and set to new values every 100 microseconds or so (or at an approximate rate of 2.4 nanoseconds per word). Even if it were possible for the beam steering computer to perform all of the required calculations sufficiently rapidly, it is impractical for the beam steering computer to distribute phase shifter commands that rapidly to the drivers 20. To that end, in accordance with the present invention, the distributed control architecture is implemented to allow for the computation and data transfer in parallel.

Referring once again to FIG. 1A, array 12 is operatively subdivided into plural sub-arrays 34. In the preferred embodiment, sub-arrays 34 are each rectangular (e.g., they may each contain the same number of RF blocks 14 in each row and in each column so that a "square" of adjacent elements is defined)—and all sub-arrays have the same number of elements. For example, suppose array 12 has 64×64 elements for a total of 4096 elements (RF blocks 14). This array 12 can be subdivided into 64 sub arrays 34 each of which comprise an 8×8 array (64) of RF blocks 14. Each element in any given sub-array 34 is located in close proximity to all other elements in the sub-array—and moreover, a predetermined positional arrangement between the "matrix" of elements in any given sub-array typically exists (i.e., because RF blocks 14 are generally equally spaced apart for various reasons, including allowing matrix type linear algebraic calculations to be used to calculate phase shift offsets such that each value in a calculated result matrix corresponds in position to a specific element in the physical "matrix" of RF elements).

In accordance with one aspect of the present invention, a different PIE 30 is assigned to each sub-array 34 (see FIG. 1). Thus, in the preferred embodiment, there are 64 PIEs 30—one for each of the 64 sub-arrays 34. A PIE 30(0,0) is assigned to sub-array 34(0,0), a PIE 30(1,0) is assigned to a sub-array 34(1,0), . . ., a PIE 30(K,0) is assigned to sub-array 34(K,0), . . , and a PIE 30(K,J) is assigned to sub-array 34(K,J). Each PIE 30 receives from a beam steering computer 32 only parameters which are independent of position in the array 12 (e.g., beam pointing angle, and array rotational orientation). Each PIE 30 then performs the calculations needed to compute a specific phase shift command for each of the RF blocks 14 in the sub-array it is assigned to, and controls those RF blocks in accordance with those calculated phase shift commands. Moreover, the PIEs 30 perform these calculations in parallel for their respective sub-arrays 34—thus distributing the computational load through-out the system 10 while avoiding the requirement for computation hardware at each individual RF block 14.

The preferred embodiment allows the geometry of the array to be fit into an arbitrary rectangular matrix, but the array itself need not be rectangular. For example, some PIEs 30 may not be completely utilized and some may not even be required (e.g., if a circular array configuration is used, no PIE 30(0,0) would be used because sub-array 34(0,0) would not even be present).

Each PIE 30 in the preferred embodiment thus converts commands calculated by beam steering computer 32 into actual pulse commands which it then provides to the array drivers 20 within the RF blocks 14. PIEs 30 also provide linearization, temperature and other compensation (as will be explained) in order to minimize the amount of data that needs to be transferred from beam steering computer 32 to the PIEs. A portion of the data manipulation required to calculate phase shifts is also performed in each PIE 30 (i.e., all computation involving parameters which change depending upon array element) in the preferred embodiment.

Briefly, beam steering computer 32 broadcasts six values to all PIEs 30 in preparation for a beam update. These six values in the preferred embodiment comprise delta azimuth angle and delta elevation angle (which together specify the beam pointing angle); and four rotational parameters (2 for x and 2 for y) required for beam spoiling rotational compensation. Beam steering computer 32 beforehand initializes random access memories within each PIE 30 with various array element-specific parameters required for the phase shift calculation (e.g., compensation for feed line delay to assure a common wave front, additional parameters arrived at by experimentally testing the performance characteristics of the individual array elements, and the like). In addition, each PIE 30 is pre-loaded beforehand with linearization data specifying linearization mapping of the final phase shift offset angle and the drive current coefficients required by individual element phase shifters 18 for different array temperatures, different array operating frequencies, and different element types. Upon receiving the coefficients broadcasted by beam steering computer 32, the PIEs 30 calculate final phase shift offset angles in parallel for all of the elements in the array 12. Specifically, each PIE 30 calculates and stores the phase shift offset angle for each of the elements in its associated sub-array 34 essentially sequentially—but each PIE 30 performs its own calculations in parallel with those being performed by all other PIEs 30. In this way, the same PIE 30 hardware can be used to calculate the phase shift offset angles for multiple elements (thus achieving great savings in hardware costs and complexity). The hardware within each PIE 30 in the preferred embodiment is fast enough and the number of calculations performed by each PIE are limited (e.g., by the size of sub-arrays 34) such that rapid beam update rates (e.g., on the order of 10 kHz) are nevertheless provided. In the preferred embodiment described herein, the total number of data words that need to be transferred from the beam steering computer 32 to each PIE 30 is only six—a significant improvement over the non-parallel approach. The beam steering computer 32 can provide the delta azimuth and delta elevation phase angles of the new beam positions in constants relating to the spatial location of the array. Distributed control system 10, in accordance with the present invention, takes advantage of this approach and is flexible enough to accommodate any particular geometry with only slight modification.

Figure 2A:
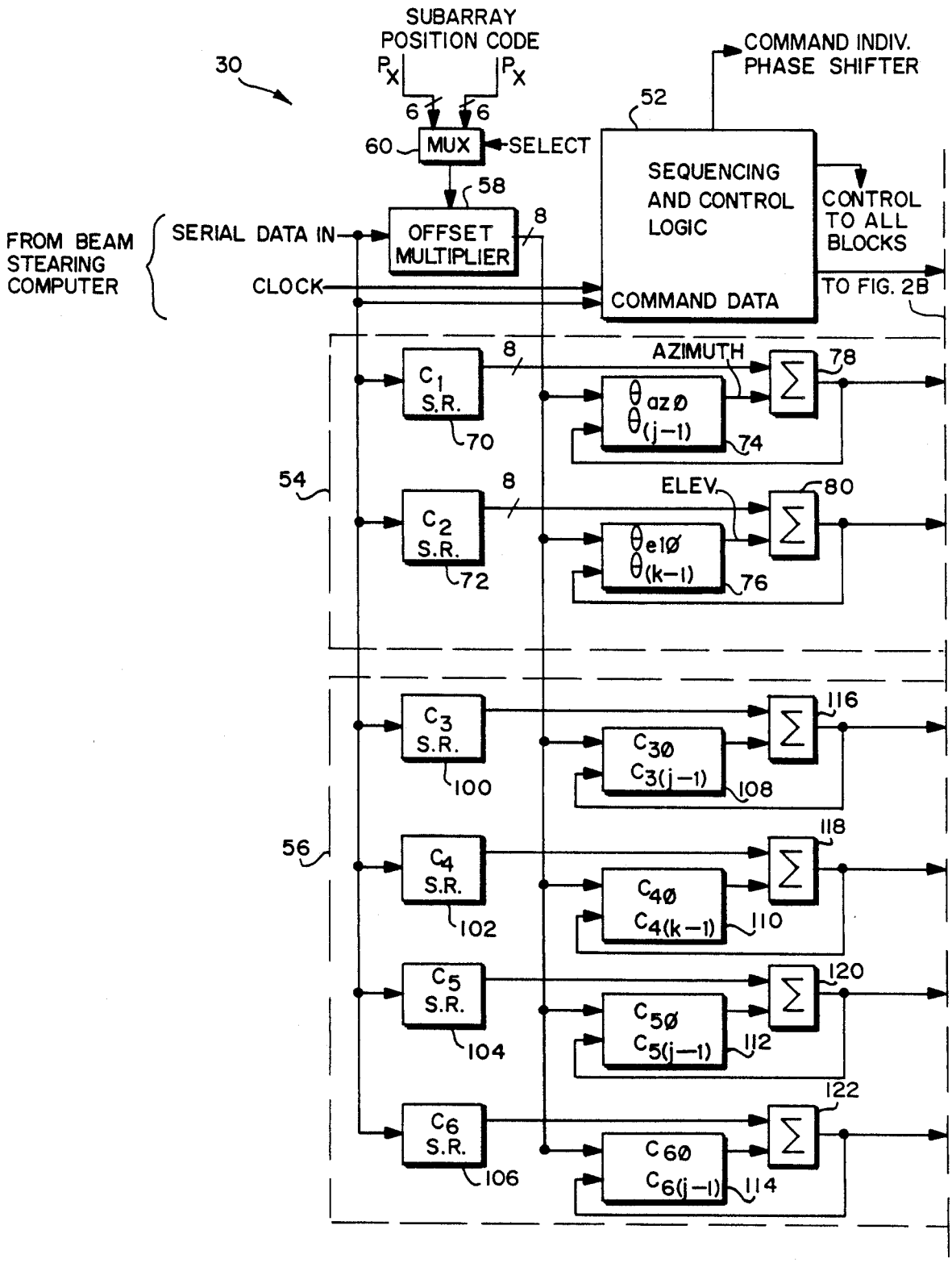
FIGS. 2A & 2B are a detailed block diagram of one of the sub-array phase shift command calculation units (phase shifter interface electronics—"PIE") shown in FIG. 1.
Figure 2B:
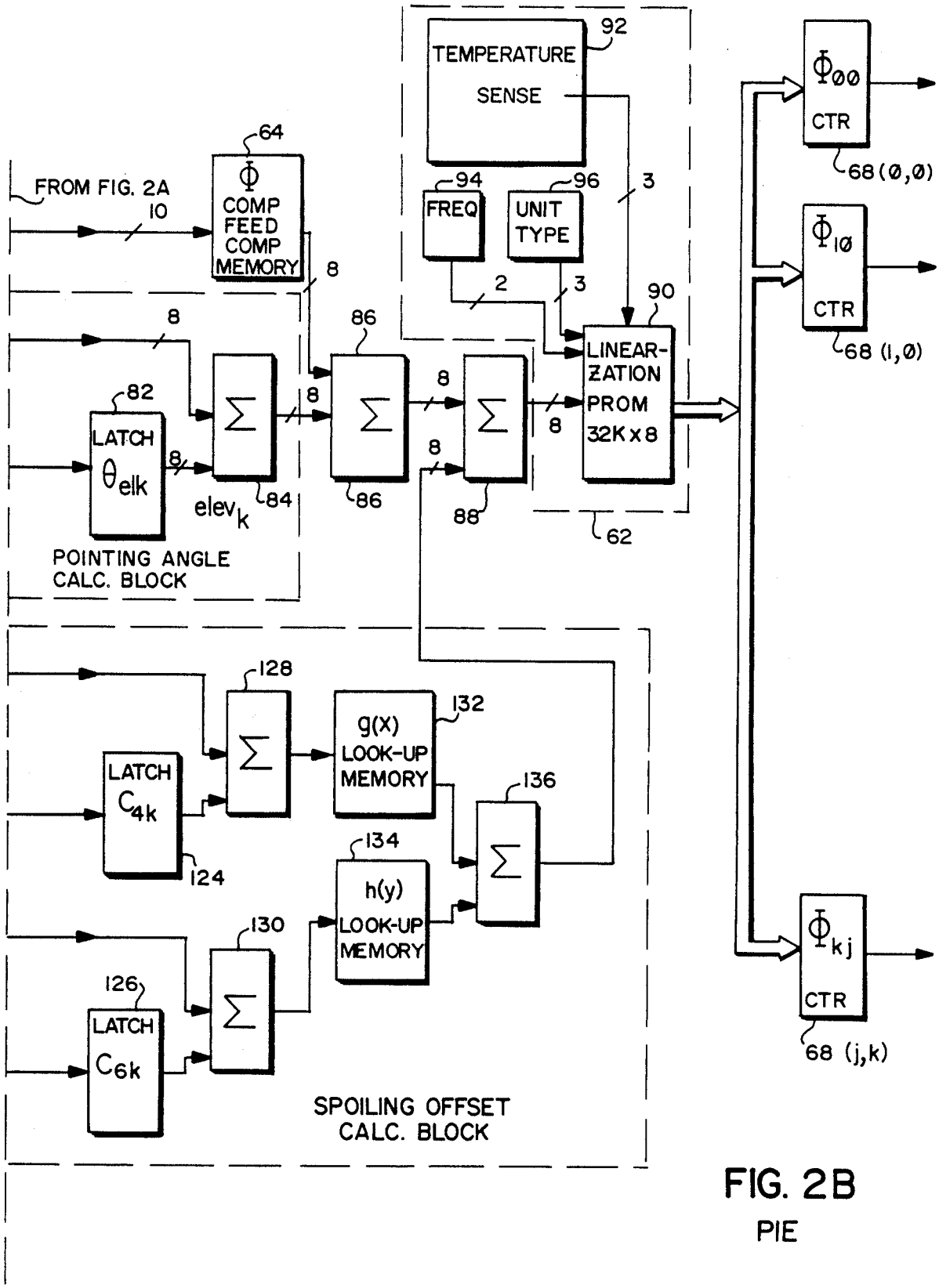

FIGS. 2A–2B are together a detailed schematic block diagram of one of PIEs 30 shown in FIG. 1. PIE 30, in the preferred embodiment, includes a sequencing and control unit 52, a pointing angle calculation block 54, a spoiling offset calculation block 56, an offset multiplier 58 and associated sub-array position code multiplexer 60, a linearzation block 62, the feed compensation RAM 64, an output data bus 66, and an array of counter/registers 68. In the preferred embodiment, there are sixty-four counter/registers 68—one for every RF block 14 in the sub-array 34 associated with PIE 30. As shown in FIG. 1, each sub-array 34 is arranged in the matrix having K+1, 80 and 84, and (k=0,1, . . . ,K) rows and J+1 columns (and in the preferred embodiment, K=7 and J=7 for a total of sixty-four elements in the sub-array). Thus, in the preferred embodiment, there are sixty-four counter/registers 68—68(0,0) through 68(J,K).

In the preferred embodiment, sequencing and control logic block 52 comprises a combinatorial state sequencer which accepts command data in serial form from beam steering computer 32 and controls all of the other blocks of the PIE 30. In the preferred embodiment, PIE 30 comprises highly integrated semi-custom gate array components to minimize space, weight and power requirements. Since PIE 30 is highly modular, economy is enhanced by utilizing the same gate array component a number of times during a phase shift offset calculation. Sequencing and control logic 52, in the preferred embodiment, provides various clocking, chip enable, and address signals to various other blocks in PIE 30 in order to operate those other blocks at the appropriate time in the appropriate manner. The design of state sequencers, using gate array components, is well known to those of ordinary skill in the art, and the internal details of sequencing and control logic 52 therefore need not be described in further detail except to specify the overall sequence and functionality of the remainder of PIE 30 (which will be described in greater detail shortly).

Pointing angle calculation block 54 includes a $C_1$ input shift register 70, a $C_2$ input shift register 72, calculation blocks 74 and 76, summers 78, 80 and 84, and an intermediate result storage latch 82. In the preferred embodiment, input shift registers 70 and 72 are each connected to receive serial data provided by beam steering computer 32. Shift registers 70 and 72 are capable of loading a byte of serial data (thereby converting that serial data into parallel data) and storing the data as long as is necessary to perform a given calculation. Offset multiplier 58 (a hardware type arithmetic multiplier) may simultaneously receive the same serial data being loaded by input registers 70 and 72, and perform an arithmetic multiplication to provide the product of the serial data and a sub-array position code of either $P_x$ or $P_y$ (the selection between these two values being controlled by sequencing and control logic 52).

In the preferred embodiment, the values $P_x$ and $P_y$ are hard-wired to specify the position of the sub-array 34 within array 12 (and thus also specify, in effect, the position of the "first" sub-array RF block 14(0,0) with respect to the position of the "first" RF block 14(0,0) within the "first" sub-array 34(0,0) of the array) The sub-array position codes $P_x$, $P_y$ thus define, for PIE 30, a subset ("sub-array") of RF radiating elements for which calculations are to be performed. As described this sub-array consists of a set of contiguously located RF array elements in the preferred embodiment. As will be explained, the parameters $P_x$, $P_y$ and offset multiplicand are used to calculate "zero offset" values which can then be used as "base" values for the calculations for the individual RF blocks 14 within the sub-array 34. That is, PIE 30 need only add further offset values for a given sub-array RF block 14 to the appropriate "zero offset" values it first calculates for sub-array RF block 14(0,0) to arrive at a "final" phase offset value for that given RF block.

In the preferred embodiment, offset multiplier 58 provides its resulting product to the appropriate calculation blocks 74 or 76 (each calculation block includes internal storage for the offset multiplier 58 result and for other intermediate results provided by the summation of the output of the calculation block 74 or 76 and the output of input shift registers 70 and 72 performed by summers 78 and 80). A latch 82 connected to the output of summer 80 temporarily stores an intermediate result $\theta_{elk}$ (that is, elevation k) for summation by summer 84 with the output of summer 78. The output of summer 84, in turn, is added to the output of compensation RAM 64 by a further summer 86. In the preferred embodiment, compensation RAM 64 contains prestored transmission line delay compensation values corresponding to each of the elements of the sub-array 34 associated with each PIE 30. These compensation values are stored in RAM 64 beforehand by beam steering computer 32 in the preferred embodiment. Sequencing and control logic 52 addresses RAM 64 appropriately so that appropriate compensation values are added to the final phase angle offset provided at the output of summer 84 (thus compensating for differences in feed line delay for the various elements).

The output of summer 86 in the preferred embodiment is the final phase shift offset angle as compensated for transmission line delay. Note that in the preferred embodiment, summer 86 actually produces a sequence of sixty-four different final phase shift offset angles—one for each of the sixty-four RF blocks 14 within sub-array 34. Each of the sixty-four sequential outputs of summer 86 is applied to one input of a further summer 88. The output of summer 88 is applied to the input of linearization block 62. Linearization block 62 provides a mapping from the final offset angle calculated at the output of summer 88 to actual phase shift command that needs to be applied to the appropriate sub-array phase shifter 18 (taking into account temperature, operating frequency, and other factors as will now be explained).

In the preferred embodiment, linearization block 62 includes a linearization PROM 90, a temperature sensor 92, a frequency indicator 94 and a unit type 96. In the preferred embodiment, linearization PROM 90 stores multiple sets of linearization parameters for different frequencies, unit types and array temperatures. As those skilled in the art will readily understand, linearization of the final offset angle calculated at the output of summer 88 is typically required because typical ferrite phase shifter circuits 18 are nonlinear devices. Because it is very difficult and complex to calculate the phase shift angle using nonlinear equations, in the preferred embodiment PIEs 30 calculate linear expressions to provide a result which is then mapped into the appropriate command value using a one-to-one mapping stored in PROM 90 beforehand. However, in the preferred embodiment, linearization PROM 90 can actually map a given final phase offset angle provided at the output of summer 88 into any one of various different linearized values depending upon the state of other input parameters.

Specifically, the output of summer 88 forms one portion of an address used to select an eight bit word stored in linearization PROM 90. However, the outputs of temperature sensor 92, unit type block 96 and frequency block 94 are also used to provide other bits of the address applied to linearization PROM 90. Thus, the word prestored in linearization PROM 90 which is selected for output onto data bus 66 depends upon four different factors of the preferred embodiment:

(1) the calculated phase offset angle;
(2) the frequency of operation;
(3) the unit type; and
(4) array temperature.

Temperature sensor 92 in the preferred embodiment includes a conventional sensor element (e.g., a thermistor or the like) which provides a temperature-indicating analog voltage to the input of a conventional analog-todigital converter (not shown). The output of the A/D converter provides, in the preferred embodiment, a three-bit value used to address linearization PROM 90.

Frequency block 94 in the preferred embodiment is a latch storing a value provided, for example, by sequencing and control logic 52. Sequencing and control logic 52 may receive a command from beam steering computer 32 indicating which of four different possible frequency ranges the array 12 is being operated at and sets the contents of frequency block 94 in response to the array operating frequency.

Unit type block 96, in the preferred embodiment, comprises a further memory device addressed by sequencing and control logic 52 on an element-by-element basis. Unit type block 96 stores, for each of the sixty-four RF blocks 14 in sub-array 34, one of eight different unit type values corresponding to the specific array elements 18 the phase shift command is currently being calculated for. In the preferred embodiment, different sets of linearization data are stored in linearization PROM 90 for each of eight different temperature ranges, for each of four different frequency ranges, for each of eight unit types, and for each of sixty-four different phase offset angles. When the array is first constructed and tested, various tests are performed on each array element individually to determine which "type" of element it is. That is, each array element is tested individually and characterized as being one of eight different element "types" based upon performance characteristics.

Thus, the preferred embodiment provides a trade-off between the size of linearization PROM 90 (64K×8 in the preferred embodiment) and optimization for the characteristics of individual array RF blocks 14 by performing linearization mapping which is semi-customized for array element characteristics. While more accurate results might be achieved by storing specific linearization data for each and every array element individually based upon measured performance characteristics, the size of linearization PROM 90 would be too large using currently available fast memories, and such extremely accurate linearization mapping is typically not required in most applications.

Figure 5:
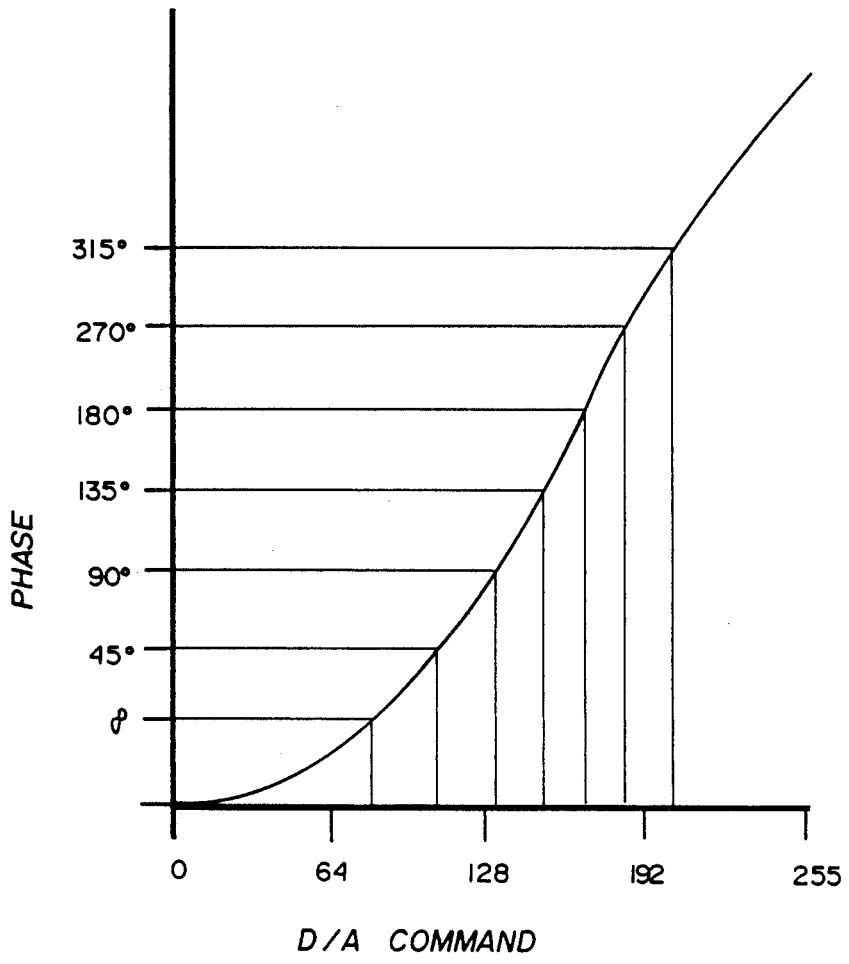
FIG. 5 is a graphical illustration of exemplary compensation/linearization functions provided by the preferred embodiment shown in FIG. 1 on an element-by-element basis.

FIG. 5 is a graphical illustration of exemplary linearization data stored in PROM 90 for phase versus command word. IN the preferred embodiment, PROM 90 provides a phase output command responsive to a digital ("D/A") input command in accordance with such prestored data.

Linearization block 62 provides an eight bit parallel output which represents the duration of the pulse which must be applied to the appropriate phase shifter circuit driver 20 in order to provide the desired phase shift for the phase shift circuit 18 of a given RF block 14. Linearization PROM 90 provides this output onto the data bus 66. Meanwhile, the sequencing and control logic 52 selects the location of counter/registers 68 corresponding to the array RF block 14 the pulse width command corresponds to and applies a load command to that counter/register 68 to cause the counter/register 68 to load the value in parallel. This process continues for each of the sixty-four counter/registers 68 until each has been loaded with an appropriate phase shift command. When all counters/registers 68 have been loaded, PIE 30 applies a "go" or "start" command to all of counters/registers 68 by setting them into the down-count mode by applying the system clock synchronization signals to all of them simultaneously. These signals, in turn, cause all of the counters/registers 68 to produce a logic level low active signal and to begin counting down. When each counters/register 68 reaches a zero count, it stops counting and ceasing producing a logic level low active signal. Thus, the duration of the signal each counter/register 68 produces depends upon the value loaded into it beforehand from the output of linearization block 62.

Spoiling offset calculation block 56 would be unnecessary if no array spoiling was required. However, the preferred embodiment system 10 is capable of spoiling the array 12 asymmetrically (i.e., different spoiling contours may be applied in the azimuth and elevational planes)—and moreover, is capable of compensating the spoiling function for different array 12 orientations (e.g., as the array 12 is rotated due to aircraft roll maneuvers or the like). Spoiling offset calculation block 56 shown in FIGS. 2A and 2B calculates an add1tional offset corresponding to the spoiling function offset value for each array element 14 and applies this spoiling offset to the other input of summer 88 for summation into the value provided at the output of summer 86. Briefly, spoiling offset calculation block 56 accepts four different rotational input parameters from beam steering computer 32 and stores those four rotational parameters in input shift registers 100–106. In addition, the values provided by beam steering computer 32 are multiplied by offset multiplier 58 (the same multiplier used to provide inputs to blocks 74 and 76) with the selected sub-array position code $p_x$ or $p_y$ and the resulting product is stored in the appropriate calculation block 108-114 as rotational parameters $C_{30}$–$C_{60}$. Summers 116–122 sum the contents of shift registers 100–106, respectively, with the outputs of calculation blocks 108-114, respectively. Latches 124 and 126 are used to store intermediate results, and summers 128 and 130 provide final calculated values that are then mapped into other values using look-up tables stored in memories 132 and 134. Output summer 136 sums the outputs of look-up memories 132 and 134, and provides an eight-bit value to the other input of summer 88 (this output value corresponding to a spoiling offset compensated for the current angular orientation of the array).

Now that the overall structure and architecture of PIE 30 has been described, a more detailed description of the calculations performed by the PIE 30 will be presented.

First consider a rectangular matrix of phased array elements with a beam direction in the horizontal plane given by the azimuth angle $\theta_{az}$ and in the vertical plane given by the elevation angle $\theta_{el}$. The basic beam steering function is performed by providing different phase shifts through each element of the array according to the following expressions:

$$(2\pi/.\lambda)d_1(\sin(\theta_{az})p+(2\pi/\lambda)d_2(\sin(\theta_{eil})q+\phi_{comp}$$

where $\lambda$ is the wavelength, $d_1$ is the distance between elements in the horizontal direction, $d_2$ is the distance between elements in the vertical direction, p is the element number in the horizontal direction, q is the element number in the vertical direction, and $\phi_{comp}$ is the phase compensation value supplied by the beam steering computer.

The difference in the phase shifts between adjacent elements for a non-spoiled beam is:

$$\text{Delta azimuth phase angle}=(2\pi/\lambda)d_1 \sin(\theta_z); \text{ and}$$

$$\text{Delta elevation phase angle} = (2\pi/\lambda)d_2 \sin(\theta_{ek}).$$

Next consider elements of the entire array placed in a Cartesian coordinate system such that each element is $E_{qr}$ (where q corresponds to the $q^{th}$ element in the x direction and r corresponds to the $r^{th}$ element in the y direction) and apply an arbitrary rotation such that the original reference axis becomes x' and y' (see FIG. 3). There is associated with the beam elevation and azimuth angle a $\delta\theta_{el}$ measured in the y' direction and a $\delta\theta_{az}$ measured in the x' direction. Phase spoiling offsets can generally be expressed as separable functions in azimuth and elevation:

$$f(x',y') = g(x') + h(y')$$

For any rotation $\alpha$, $$x = x'\cos\alpha - y'\sin\alpha$$

$$y = x'\sin\alpha + y'\cos\alpha$$

$$x' = x\cos\alpha + y\sin\alpha$$

$$y' = -x\sin\alpha + y\cos\alpha$$

Then for the translated array, $$\delta\theta_x = \delta\theta_{az}\cos\alpha - \delta\theta_{el}\sin\alpha,$$

$$\delta\theta_y = \delta\theta_{az}\sin\alpha + \delta\theta_{el}\cos\alpha,$$

and $$f(x',y') = g(x\cos\alpha + y\sin\alpha) + h(-x\sin\alpha + y\cos\alpha).$$

If $x_q = qd_1$, $y_r = rd_2$, then $$f(x',y') = F(q,r) = g(qd_1\cos\alpha + rd_2\sin\alpha) + h(-qd_1\sin\alpha + rd_2\cos\alpha),$$

and the final desired phase for each element can be expressed as;

$$\Phi(q,r) = q\delta\theta_x + r\delta\theta_{yl} + F(q,r)$$

With the following substitutions:

$$C_1 = \delta\theta_x,$$

$$C_2 = \delta\theta_y,$$

$$C_3 = d_1\cos\alpha,$$

$$C_4 = d_2\sin\alpha,$$

$$C_5 = -d_1\sin\alpha,$$

$$C_6 = d_2\cos\alpha,$$

the phase for each element $E_{qr}$ becomes:

$$\Phi(q,r) = qC_1 + rC_2 + g(qC_3 + rC_4) + h(qC_5 + rC_6)$$

The preferred embodiment of system 10 uses the expression above to provide a computational algorithm that is general for any arbitrary q by r array. Moreover, the function F(x',y') is calculated in accordance with the expression as the simple summation of the two functions h(y') and g(x'). Thus, the preferred embodiment calculates h(y') (using components 100, 102, 108, 110, 116, 118, 124, and 132) and g(x') (using components 104, 106, 112, 114, 120, 122, 126, 130 and 134) independently—and then simply sums the two results together (this summation is performed in the preferred embodiment by summer 136). While a change to the algorithm can be made to accommodate for interdependence between the the functions of x' and y', such a change would require more memory and possibly additional computational complexity.

Another important feature of the $\Phi(q,r)$ expression set forth above is that it permits calculations for the array to be broken up into smaller sub-matrices 34 with little computational penalty. These sub-matrices 34 allow the array to be controlled by a distributed system 10 in the preferred embodiment having the speed advantage of parallel processing. Further, the six parameters ($C_1$, $C_2$, $C_3$, $C_4$, $C_5$ and $C_6$) that are needed to perform the computations are common to all sub-arrays 34 and so can be broadcasted by beam steering computer 32 to all sub-array 34 controllers in parallel, thus avoiding a data transfer "bottleneck" of transferring commands from the beam steering computer to each individual phase shifter.

The coefficients $C_3$–$C_6$ are the parameters associated with a rotating spoiling pattern and when these are zero the result is that of a stationary array. In a stationary array, changing the parameters $C_3$–$C_6$ could be used to change the spoiling pattern.

Figure 4A:
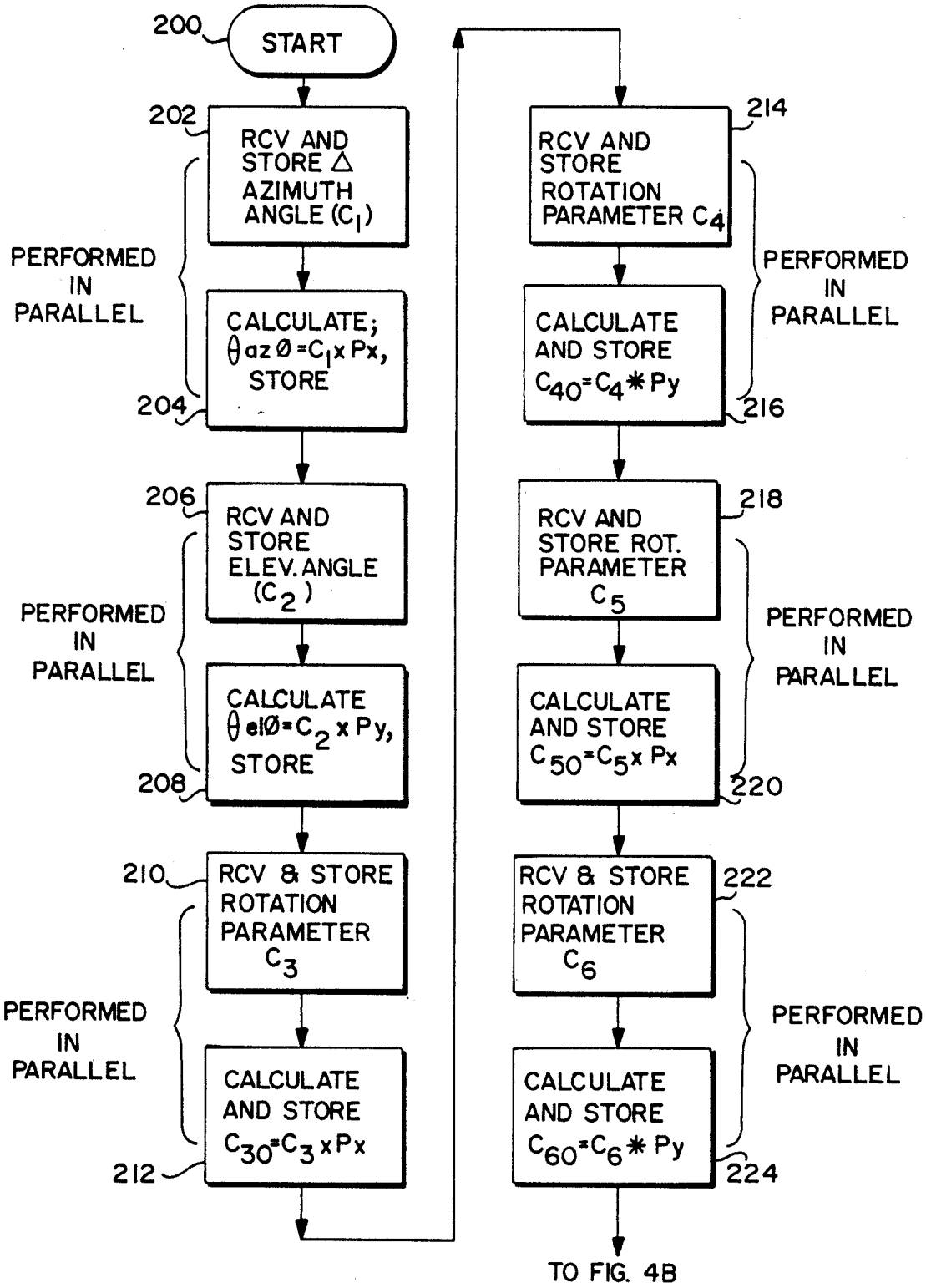
FIGS. 4A–4B together are a schematic flow chart of control steps performed by the PIE shown in FIGS. 2A–2B.
Figure 4B:
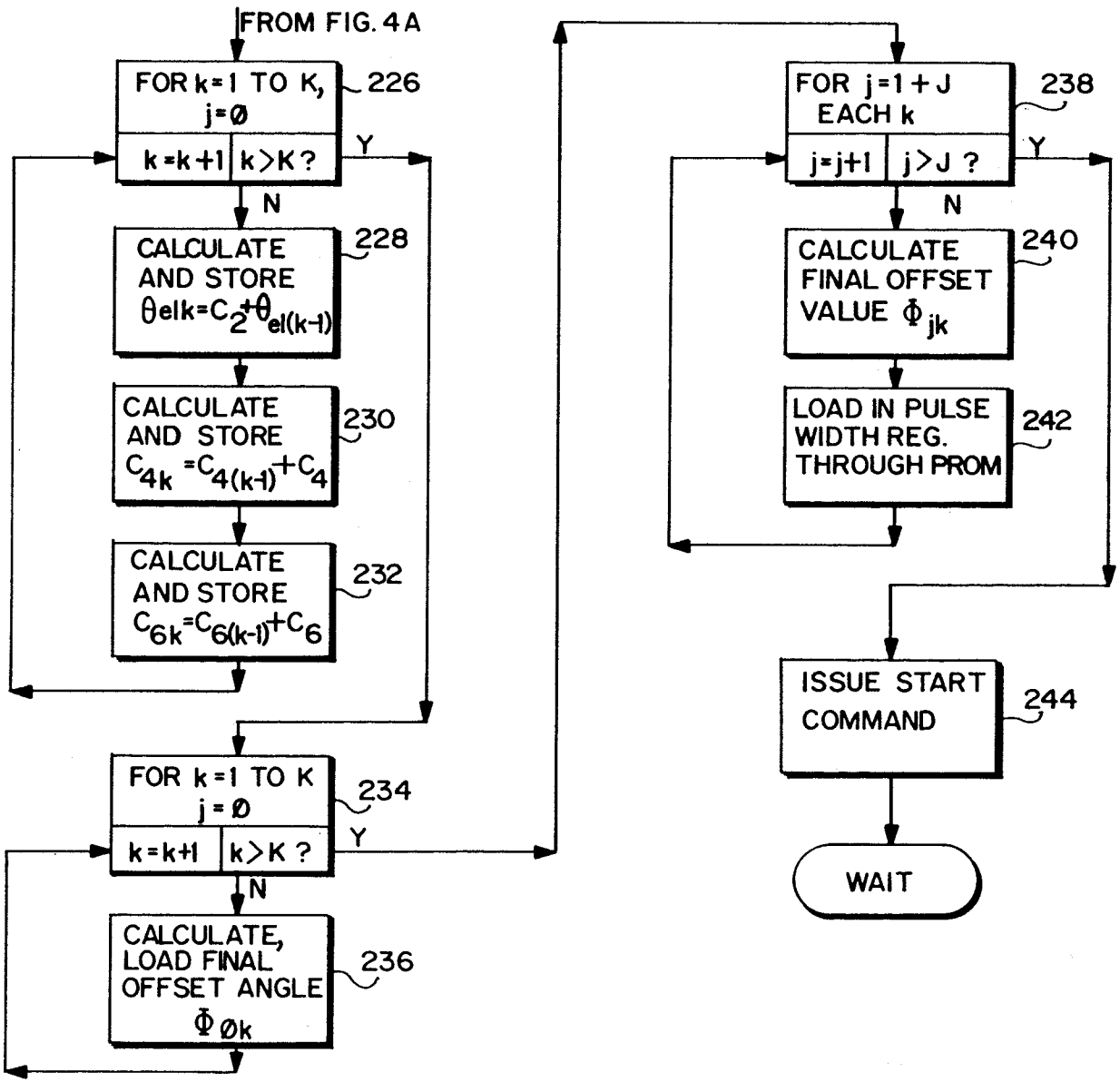

FIGS. 4A–4B are together a schematic flowchart of exemplary steps performed by the PIE 30 shown in FIGS. 2A–2B in the preferred embodiment. The steps described in FIGS. 4A–4B are performed by various blocks of PIE 30 under control of sequencing and control logic block 52. Briefly, by performing the steps shown in FIGS. 4A–4B, the PIE 30 (a) receives parameters broadcasted by beam steering computer 32 specifying new beam pointing angle and angular orientation, (b) calculates a new phase shift command for each element in its associated sub-array 34 and loads those commands into counter/registers 68, and (c) controls the counter/registers 68 to produce pulse width type phase shift commands for application to the sub-array element driver circuits 20.

In more detail, the process performed by PIE 30 begins by receiving the delta azimuth phase angle $C_1$ broadcasted serially to all PIEs 30 by beam steering computer 32 and storing this value into input register 70 (block 202; in the preferred embodiment, input register 70 is a shift register so that the serial-to-parallel conversion is handled automatically when the serial data is loaded into the input register 70). At the same time that input register 70 is loading parameter $C_1$, offset multiplier 58 (which in the preferred embodiment is a fast arithmetic multiplier) is multiplying the $C_1$ parameter by $P_x$ (selected by multiplexer 60 under control of sequencing and control logic 52) and stores the $\theta_{az\phi}$ result within calculation block 74 (block 204). Here $P_x = m \times j$, where m is the number of the block of elements 14 in the horizontal direction (and similarly, $P_y$ = where n×k, n is the number of the block of elements 14 in the vertical direction). Blocks 202, 204 are actually performed in parallel in the preferred embodiment even though they are shown sequentially in FIG. 4A.

Similarly, blocks 206, 208 receive delta elevation phase angle, multiply it by $P_y$, store $C_2$ into input register 72, and store the product $\theta_{e10} = (C_2 * P_y)$ into +Ke calculation block 76. Blocks 210, 212 receive rotation parameter $C_3$ broadcasted by the beam steering computer 32, multiply it by $P_x$ ($C_3 * P_x = C_{30}$), and store $C_3$ and $C_{30}$ into input register 100 and calculation block 108, respectively. Blocks 214, 216 receive rotation parameter $C_4$, multiply it by $P_y$ ($C_4 * P_y = C_{40}$), and store $C_4$ and $C_{40}$ into input register 102 and calculation block 110, respectively. Blocks 218, 220 receive rotational parameter $C_5$, multiply it by $P_x$ ($C_5 * P_x = C_{50}$), and store $C_5$ and $C_{50}$ into input register 104 and calculation block 112, respectively. Blocks 222, 224 receive rotational parameter $C_6$, multiply it by $P_y$ ($C_6 * P_y = C_{60}$), and store $C_6$ and $C_{60}$ into input register 106 and calculation block 114, respectively.

Using a serial clock rate of 8 MHz with an assumed total number of horizontal elements of 64 and vertical elements of 64 (64×64), the communication sequence of transferring the six required parameters takes only 11.3 μs.

Thus, at this point the PIE 30 has loaded the six coefficients $C_1$–$C_6$ broadcasted by beam steering computer 32 (these parameters are not dependent upon the position of the sub-array 34 and are therefore used by all PIEs 30); and has also multiplied those parameters by the $P_x$ and $P_y$ position codes to obtain the values $\theta_{az10}$ and $\theta_{e10}$ and coefficients $C_{30}$–$C_{60}$ (these multiplied values are dependent upon the position of elements within sub-array 34). The steps shown in FIG. 4B perform the calculations required to provide phase shift offsets for each individual element within the associated sub-array 34.

First, blocks 226–232 perform the following calculations for each row of RF blocks 14 in the sub-array 34 (k=1 to K, j=0, where J is the number of RF blocks 14 in the horizontal direction and K is the number of RF blocks 14 in the vertical direction):

(i) calculate and store $\theta_{elk} = C_2 + \theta_{el(k-1)}$ (this calculation is performed at FIG. 4B block 228 by components 72, 76, 80 and stores the results in latch 82);

(ii) calculate and store $C_{4k} = C_{4(k-1)} + C_4$ (this calculation is performed at FIG. 4B block 230 by components 102, 110, 118 and the results are stored within latch 124); and (iii) calculate and store $C_{6k} = C_{6(k-1)} + C_6$ (this calculation at FIG. 4B block 232 is performed by components 106, 114, 122 and the results are stored in latch 126).

Of course, FIG. 4B blocks 228, 230, 232 are actually performed in parallel in the preferred embodiment (although they are shown sequentially in FIG. 4B for ease of description).

Since blocks 228–232 are repeated for each row of sub-array 34 in the preferred embodiment, latches 82, 124, 126 are each "wide" enough to store a different result for each row (8 different results for each of the 8 sub-array rows in the preferred embodiment).

Once the intermediate results have been stored in latches 82, 124, 126, blocks 234, 236 use the intermediate results stored in latch 82 to calculate a final phase offset angle for the "first" element in each row (i.e., j=0) in accordance with the following expression:

$$\Phi_{Ok} = \theta_{azO} + \theta_{elk} + h(C_{50} + C_{6k}) + g(C_{30} + C_{4k}) + \phi_{compOk}.$$

where g(x′) and h(y′) are generated from memory elements 132, 134 and $\phi_{comp}$ is the phase antenna feed compensation (delay) value stored beforehand by the beam steering computer 32 into RAM 64 (note that this expression does not include j−1 or k−1 terms since j and k can't be negative in the preferred embodiment). This expression is evaluated by all of components 64, 70–88, 100–136 with the results being linearized by linearization block 62 and stored in output counter/registers 68(0,1)–68(O,K) (i.e., for all elements in the "first" column j=0 of the sub-array 34) via bus 66. Thus, to perform this calculation components 70–88, 100–136 process the different terms in the expression in parallel, although in the preferred embodiment the evaluation of the expression for different elements is performed sequentially.

Next, blocks 238–242 calculate the final offset angle for all the rest of the elements in the sub-array 34. That is, for columns j=1 to J (J=8 in the preferred embodiment), each row (k) has the expression $$\Phi_{jk} = C_1 + \theta_{az(j-1)} + \theta_{elk} + g(C_{3(j-1)} + C_3 + C_{4k}) + h(C_{5(j-1)} + C_5 + C_{6k}) + \phi_{compjk}$$

which is evaluated by components 70–88, 100–136 and the results are stored in output counter/registers 68(1,0)–68 (J,K) (after being linearized, temperature and frequency compensated, and compensated for the phase shift characteristics of particular elements 18 by linearization block 62 and after being delay compensated by RAM 64 through summer 86). Hence, this calculation is actually sequentially performed 56 times in the preferred embodiment with the various terms in the expression being evaluated in parallel for each calculation.

The expressions shown above are performed modulo 360° such that overflows do not affect the accuracy of the command. The amount of time that it takes to perform the above sequence depends on the configuration of the array and the system clock rate.

At this stage, all of the output counter/registers 68 have been loaded with a final phase shift offset value. In the preferred embodiment, sequencing and load control logic block 52 may wait for a start command—or it may simply issue a start command itself when all calculations are performed (since in the preferred embodiment all PIEs 30 have identical configurations, are clocked by the same system clock, and perform the same steps, they will all be "done" at essentially the same time). The start command enables the active low "borrow" outputs of all of output counter/registers 68—thus providing output pulse command signals to their associated phase shifter drivers 20. The output counter/registers 68 are also controlled to begin counting down at this point so that they each terminate their pulse at different times determined by the value they initially contain.

BEAM STEERING COMPUTER

Beam steering computer 32 in the preferred embodiment is responsible for calculating coefficients $C_1$–$C_6$ and broadcasting those coefficients to all PIEs 30—with all other calculations being performed by the PIEs. The beam steering computer 32 calculates these coefficients in a conventional manner in response to desired pointing angle information specified by the operator or the like and also in response to beam angular orientation information (e.g., obtained from an aircraft inertial guidance system). In the preferred embodiment, a simple communications protocol (e.g., a start bit, a three bit command word, and the appropriate data protected from errors by an error checking code that follows) is used to communicate the coefficient values (or other commands) to the PIEs 30. In the preferred embodiment, beam steering computer 32 transmits the command "broadcast delta phase" before transmitting the six "C" coefficients.

Beam steering computer 32 is also able to apply four other commands to the PIEs 30.

broadcast compensation table;
command single phase shifter;
load compensation RAM; and
load compensation RAM sequentially.

The "broadcast compensation table" command is used to load the spoiling lookup tables into the memories 132, 134 of all PIEs 30 simultaneously. Typically, the spoiling function will not be changed very often (e.g., perhaps only on a mission basis). However, the preferred embodiment does provide the flexibility of changing spoiling patterns at will—although the time required for loading RAMs 132, 134 is substantially greater than that permitted for the beam update rate. Upon receipt of this command, sequencing and control logic 52 accepts the following data stream it receives from beam steering computer 32 and loads it into RAMs 132, 134 in a conventional manner.

The "command single phase shifter" command is used in the preferred embodiment to perform diagnostics and system calibration. In the preferred embodiment, this command includes a 12-bit address specifying a particular PIE 30 and a specific sub-array RF block 14 associated with that PIE 30. Following this address is a value directly specifying the final phase offset for the addressed element 18. In the preferred embodiment, this command is used to, in effect, "bypass" the computations performed by PIE 30 and to permit the beam steering computer 32 to directly specify the phase offsets for any particular element in the array. Upon receipt of a "command single phase shifter" command, the sequencing and control logic block 52 first determines whether the command it intended for it (i.e., by comparing the first part of the address with an address pre-assigned to the PIE). If the command is intended for the PIE 30, the sequencing and control logic block 52 receives the second part of the address (specifying a particular RF block 14 in its associated sub-array) and selects the appropriate output counter/register 68 in response to this second address part. Finally, the sequencing and control logic block 52 places the phase offset information specified by the beam steering computer 32 onto bus 66, controls the selected counter/register 68 to load that information, and then issues the associated element driver 20 a command to switch to the new state.

The "load compensation RAM" and "load compensation RAM sequentially" are used to alter the contents of RAM 64. The "load compensation RAM" command permits the beam steering computer 32 to alter a single entry stored in RAM 64 of a specific PIE 30 by specifying (a) the PIE address, (b) the address within RAM 64 of the entry to be changed, and (c) the value of the new entry. The "load address within RAM 64 of the entry to be changed, and (c) the value of the new entry. The "load compensation RAM sequentially" permits beam steering computer 32 to write the entire contents of the RAM 64 of a specific PIE 30. In the preferred embodiment, the latter command is capable of loading an entire 4K byte RAM 64 in less than 10 ms if an 8 mHz system clock is used.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An RF antenna system comprising:

a first set of plural RF radiating means for radiating and/or receiving RF signals and for applying a controllable phase shift to said RF signals, a second set of plural RF radiating means for radiating and/or receiving RF signals and for applying a controllable phase shift to said RF signals, said RF radiating means each comprising:

RF radiating element means for receiving and/or radiating RF signals, and phase shifting means coupled to said RF radiating element means for applying a phase shift to said RF signals received and/or radiated by said RF radiating element means;

beam steering means for generating and broadcasting parameters to said RF radiating means of said first set and to said RF radiating means of said second set;

first processing means, coupled and corresponding to said first sub-array and connected to receive said broadcasted parameters, for calculating phase shift values corresponding to said first set of RF radiating element means and for applying said phase shift values to control the phase shifts applied by said phase shifting means of said first set of RF radiating means; and second processing means, coupled and corresponding to said second set of RF radiating means and connected to receive said broadcasted parameters, for calculating, in parallel and simultaneously with said first processing means calculations, phase shift values corresponding to said second set of RF radiating element means and for applying said phase shift values to control the phase shifts applied by said phase shifting means of said second set of RF radiating means.

2. A system as in claim 1 wherein:

each of said RF radiating means further comprises driver means coupled to said phase shifting means for controlling the phase shift applied by said phase shifting means in response to the width of a phase shift control pulse received thereby;

said first processing means includes means for converting said calculated phase shift values to phase shift control pulses of controlled widths and for applying said phase shift control pulses to said first set of RF radiating means; and said second processing means includes means for converting said calculated phase shift values to phase shift control pulses of controlled widths and for applying said phase shift control pulses to said second set of RF radiating means.

3. A system as in claim 1 wherein said first and second processing means each include respective linearizing means for linearizing said calculated phase shift values.

4. A system as in claim 3 wherein said respective linearizing means each comprise means for compensating for differences in measured phase shift characteristics of the RF radiating element means.

5. A system as in claim 3 wherein said respective linearizing means each include:

temperature sensing means for sensing array temperature; and means for compensating said calculated phase shift values for said sensed temperature.

6. A system as in claim 3 wherein said respective linearizing means each include:

means for indicating the frequency of said RF signals received and/or radiated by said RF radiating element means; and means for compensating said calculated phase shift values for said RF signal frequency.

7. A system as in claim 1 wherein:

said beam steering computer means includes means for broadcasting a further parameter specifying the rotational orientation of said array;

said first processing means includes spoiling offset calculating means connected to receive said further broadcasted parameter for calculating spoiling offset values for each of said first set of RF radiating means corresponding to said rotational orientation and for adjusting said calculated phase shift values in response to said spoiling offset values; and said second processing means includes spoiling offset calculating means connected to receive said further broadcasted parameter for calculating spoiling offset values for each of said second set of RF radiating means corresponding to said rotational orientation and for adjusting said calculated phase shift values in response to said spoiling offset values.

8. Apparatus for controlling an RF array of the type including plural RF phase shifter circuits each connected to an associated corresponding RF radiating element, said apparatus comprising:

input register means for receiving and storing a pointing angle value which is independent of RF radiating element position;

sub-array defining means for defining a predetermined sub-array of said RF radiating elements within said array, said sub-array comprising more than one but less than all of said RF radiating elements in said array;

first calculating means connected to said input register means and to said sub-array defining means for calculating an intermediate result applicable to said defined sub-array in response to said stored pointing angle value;

second calculating means connected to receive said intermediate result and also operatively connected to said input register means for calculating plural final phase offset values for said corresponding RF radiating elements within said sub-array; and output register means connected to said second calculating means for converting said calculated plural final phase offset values into pulse width phase commands and for applying said pulse width commands to respective RF radiating element phase shifter circuits within said sub-array.

9. Apparatus as in claim 8 wherein said sub-array comprises a plurality of contiguously located RF radiating elements.

10. Apparatus as in claim 8 wherein said sub-array comprises a rectangular matrix of RF radiating elements, said matrix having X rows of RF radiating elements and y columns of RF radiating elements $x \geqq 1$, $y \geqq 1$, $x \geqq 2$, $x = y$.

11. Apparatus as in claim 8 wherein said sub-array defining means includes position code specifying means for specifying the position of said sub-array within said array.

12. Apparatus as in claim 11 wherein said position code specifying means comprises means for specifying the position within said array of one RF radiating element within said sub-array.

13. An RF antenna system comprising:

an RF antenna array divided into at least first and second sub-arrays, said first sub-array comprising a first set of plural RF radiating means for radiating and/or receiving RF signals and for applying a controllable phase shift to said RF signals, said second sub-array comprising a second set of plural RF radiating means for radiating and/or receiving RF signals and for applying a controllable phase shift to said RF signals;

beam steering means for generating and broadcasting at least one pointing angle parameter and at least one array rotational parameter;

first processing means, coupled and corresponding to said first sub-array and connected to receive said broadcasted parameters, for (a1) calculating phase shift values corresponding to said first set of RF radiating element means in response to said broadcasted pointing angle parameter, (b1) calculating spoiling offset values corresponding to said first set of RF radiating element means in response to said broadcasted rotational parameter, (c1) adjusting said calculated phase shift values in response to said spoiling offset values, and (d1) controlling the phase shifts applied by said first sub-array phase shifting means with said adjusted phase shift values; and second processing means, coupled and corresponding to said first sub-array and connected to receive said broadcasted parameters and operating in parallel with said first processing means, for:

(a2) calculating phase shift values corresponding to said second set of RF radiating element means in response to said broadcasted pointing angle parameter, (b2) calculating spoiling offset values corresponding to said second set of RF radiating element means in response to said broadcasted rotational parameter, (c2) adjusting said calculated phase shift values in response to said spoiling offset values, and (d2) controlling the phase shifts applied by said second sub-array phase shifting means with said adjusted phase shift values.

14. A method for operating an RF antenna system comprising the following steps:

(a) radiating and/or receiving RF signals with a first set of plural RF radiating elements;

(b) radiating and/or receiving RF signals with a second set of plural RF radiating elements;

(c) broadcasting common parameters to said first and second sets of plural RF radiating elements;

(d) calculating plural phase shift values corresponding to and associated with said first set of RF radiating elements in response to said parameters broadcasted by said broadcasted step (c), including sequentially performing plural different calculations corresponding to said plural RF radiating elements with a calculation means operatively associated with all of said plural radiating elements within said first set;

(e) controlling shifting of the phase of RF signals radiated and/or received by said step (a) in response to said phase shift values calculated by said calculating step (d);

(f) simultaneously and in parallel with said calculating step (d), calculating plural phase shift values corresponding to and associated with said second set of RF radiating elements in response to said parameters broadcasted by said broadcasted step (c), including sequentially performing plural different calculations corresponding to said plural RF radiating elements within said second set with a further calculation means operatively associated with all of said plural radiating elements within said second set; and (g) controlling shifting of the phase of RF signals radiated and/or received by said step (b) in response to said phase shift values calculated by said calculating step (f).

15. A method as in claim 14 wherein:

said controlling step (e) includes converting said phase shift values calculated by said step (d) to phase shift control pulses of controlled widths and applying said phase shift control pulses to said first set of RF radiating elements; and said controlling step (g) includes converting said phase shift values calculated by said step (f) to phase shift control pulses of controlled widths and applying said phase shift control pulses to said second set of RF radiating elements.

16. A method as in claim 14 wherein:

said calculating step (d) includes linearizing said calculated phase shift values; and said calculating step (f) includes linearizing said calculated phase shift values.

17. A method as in claim 16 wherein said respective linearizing steps each comprise compensating for differences in measured phase shift characteristics of the RF radiating elements.

18. A method as in claim 16 wherein said respective linearizing steps each include:

sensing array temperature; and compensating said calculated phase shift values for said sensed temperature.

19. A method as in claim 16 wherein said respective linearizing steps each include:

indicating the frequency of said RF signals received and/or radiated by said RF radiating elements; and compensating said calculated phase shift values for said RF signal frequency.

20. A method as in claim 14 wherein:

said method further includes broadcasting a further parameter specifying the rotational orientation of said array;

said calculating step (c) includes calculating spoiling offset values for each RF radiating element within said first set corresponding to said rotational orientation in response to said broadcasted further parameter and adjusting said calculated phase shift values in response to said spoiling offset values; and said calculating step (f) includes calculating spoiling offset values for each of said RF radiating element within said second set corresponding to said rotational orientation in response to said broadcasted further parameter and adjusting said calculated phase shift values in response to said spoiling offset values.

21. A method for controlling an RF array of the type including plural RF phase shifter circuits each connected to an associated corresponding RF radiating element, said method comprising:

(a) receiving and storing a point angle value which is independent of RF radiating element position;

(b) defining a predetermined sub-array of said RF radiating elements within said array, said sub-array comprising more than one but less than all of said RF radiating elements in said array;

(c) calculating an intermediate result associated with all of said RF radiating elements within said defined sub-array in response to said stored pointing angle value;

(d) calculating plural final phase offset values for said corresponding RF radiating elements within said sub-array;

(e) converting said calculated plural final phase offset values into pulse width phase commands; and (f) applying said pulse width commands to respective RF radiating element phase shifter circuits within said sub-array.

22. A method as in claim 21 wherein said sub-array defining step comprises defining a plurality of contiguously located RF radiating elements.

23. A method as in claim 21 wherein said sub-array defining step comprises defining a rectangular matrix of RF radiating elements, said matrix having X rows of RF radiating elements and y columns of RF radiating elements.

24. A method as in claim 21 wherein said sub-array defining step includes specifying the position of said sub-array within said array.

25. A method as in claim 24 wherein said position code specifying step comprises specifying the position within said array of one RF radiating element within said sub-array.

26. A method of electronically steering an RF antenna array comprising the steps of:

(a) dividing said RF antenna array into at least first and second sub-arrays, said first sub-array comprising a first set of plural RF radiators, said second sub-array comprising a second set of plural RF radiators;

(b) generating and broadcasting at least one pointing angle parameter and at least one array rotational parameter;

(c) sequentially calculating phase shift values corresponding to said first set of RF radiators in response to said broadcasted pointing angle parameter;

(d) calculating spoiling offset values corresponding to said first set-of RF radiators in response to said broadcasted rotational parameter;

(e) adjusting said calculated phase shift values in response to said spoiling offset values;

(f) applying a phase shift to RF signals received and/or radiated by said first set of plural RF radiators;

(g) controlling said phase shifts applied by said step (f) in response to said adjusted phase shift values;

(h) in parallel with and simultaneously to said calculating step (c), sequentially calculating phase shift values corresponding to said second set of RF radiating element means in response to said broadcasted pointing angle parameter;

(i) calculating spoiling offset values corresponding to said second set of RF radiating element means in response to said broadcasted rotational parameter;

(j) adjusting said calculated phase shift values in response to said spoiling offset values;

(k) applying a phase shift to RF signals received and/or radiated by said second set of plural RF radiators; and (l) controlling said phase shifts applied by said step (k) in response to said adjusted phase shift values.

27. In a steerable radio frequency beam arrangement of the type including multiple array elements and associated phase shifter circuits, improved phase shift interface electronics comprising a logic network operatively coupled to a subset of said phase shifter circuits comprising more than one but less than all of said phase shifter circuits, said logic network receiving steering control signals common to said multiple array elements, said logic network generating phase shift control signals for the phase shifter circuits operatively coupled thereto in response to said received common steering control signals and in response to at least one further parameter specific to said subset of said phase shifter circuits operatively coupled thereto, and for controlling the phase shift introduced by said subset of said phase shifter circuits coupled thereto in response to said generated phase shift control signals.

28. Apparatus as in claim 27 wherein said phase shift interface electronics includes means responsive to said generated phase shift control signals for applying serial pulse width encoded control signals to each of said phase shifter circuits in said subset.

29. Apparatus as in claim 27 wherein said logic network includes storage means for storing parameters indicative of the locations of said elements corresponding to said phase shifter circuits coupled thereto.

30. Apparatus as in claim 27 wherein said phase shift interface electronics logic network includes means for compensating said phase shift for orientation of said array.

31. Apparatus as in claim 27 wherein said phase shift interface electronics logic network includes spoiling means for providing phase shift signals that spoil said array during period of array inactivity.

32. Apparatus as in claim 31 wherein said spoiling means compensates said spoiling for the orientation of said array.

* * * * *